United States Patent [19]

Johnson, II

[11] Patent Number: 5,054,957

[45] Date of Patent: Oct. 8, 1991

[54] PAVING BLOCK

[76] Inventor: John V. Johnson, II, 3772 Pineridge, Galena, Ohio 43021

[21] Appl. No.: 470,078

[22] Filed: Jan. 25, 1990

[51] Int. Cl.[5] ..... E01C 5/00

[52] U.S. Cl. ..... 404/41; 404/42

[58] Field of Search ..... 404/34, 37–42; 52/311, 313, 570, 608, 610

[56] References Cited

U.S. PATENT DOCUMENTS 4,128,357 12/1978 Barth et al. ..... 404/41
4,544,305 10/1985 Hair ..... 404/41

FOREIGN PATENT DOCUMENTS 2751536 5/1979 Fed. Rep. of Germany ..... 404/41
3409114 9/1985 Fed. Rep. of Germany ..... 404/41

OTHER PUBLICATIONS

Rampf Formen, Jul. 1984, p. 12, lower left corner.
Symetry Interlocking Paving Stones, ©1989.

*Primary Examiner*—Ramon S. Britts
*Assistant Examiner*—Gay Ann Spahn
*Attorney, Agent, or Firm*—Robert E. Stebens

[57] ABSTRACT

A paving block is provided for forming of paved surfaces comprising a plurality of the block laid in adjacent relationship. The blocks are of a planar configuration having a primary body section with coplanar top and bottom surfaces and a vertical peripheral side wall extending between the top and bottom surfaces. Four main wall elements are included in the peripheral wall with these wall elements disposed in parallel pairs, the pairs being positioned in orthogonal relationship to each other. A fifth wall element is included in the peripheral side wall and is positioned between two adjacent ones of the main wall elements in equiangular relationship to each other. In one version of the paving block, two tongue elements are provided in integrally formed relationship with the primary body section and project a distance laterally therefrom at diametrically opposed corners adjacent the respective main wall elements that are interconnected by the fifth wall element. Each tongue element is shaped in plan view to mechanically interengage with side walls of tongue elements and the fifth wall element of adjacent blocks to form a mechanical interlock of adjacently disposed blocks. A second version of the paving block has a single tongue element shaped in plan view to cooperatively interfit in each of two complementally shaped recesses cooperatively forming the fifth wall element to form a mechanical interlock between adjacently disposed blocks.

12 Claims, 6 Drawing Sheets

PAVING BLOCK

FIELD OF THE INVENTION

This invention relates in general to paving blocks primarily adapted to covering of ground surface areas, but which may also be utilized as surface coverings for floor areas of the interiors of building structures. It relates more particularly to paving blocks that are of a configuration to form a secure mechanical interlock that is capable of greatly resisting lateral displacing forces and to thereby maintain the blocks in the position in which they are laid to form a surface comprising a number of such blocks placed in adjacent relationship.

BACKGROUND OF THE INVENTION

Paving blocks in recent years have had a resurgence in their desirability for forming of surfaces for not only utilitarian surfaces, but also for decorative purposes as to residential driveways and other areas such as patios or similar function areas. Paving bricks which had heretofore fulfilled this need have generally become unavailable and the clay-based bricks now available do not have the structural characteristics that are suitable for many of these purposes and in particular are not suitable for driveways or other areas which are subjected to relatively high compressive forces. In an effort to meet this need for paving blocks having the requisite compressive structural strength, techniques have been developed to fabricate paving blocks from cement and sand mixtures. The basic technique that has developed is a technique whereby the cement, sand and water mixture is subjected to a substantial compressive force during the process of molding the desired article so as to develop the desired compessive strength. These paving blocks are alternatively known in the trade as paving stones and are also frequently referred to as paving bricks. Use of the term "paving block" in this specification and claims is not intended to be a limitation on the scope, but is to be construed as inclusive of the other terms or any terms that are of similar import.

Concurrently with development of the compression molding techniques to achieve the desired compressive strength and hardness of the resultant paving product there have been attempts to develop design configurations that would enhance the ability of the paving block to cooperatively interlock in a manner to resist lateral displacing forces. This aspect is particularly important as to paving blocks utilized in forming of paving surfaces such as for residential driveways or even for industrial driveways that are subjected to utilization by vehicles of relatively great weight that would otherwise tend to cause the blocks to be first displaced in a vertical direction and as a resultant consequence to then be laterally displaced. Various configurations of paving blocks have been developed as to their peripheral shape to effect the desired stability and resistance to lateral displacement through achieving mechanical interlocking of the adjacently disposed blocks. However, development of complexity of peripheral configurations of the paving block to resist lateral displacement has invariably resulted in a similar increase in the difficulty of placing or laying of the blocks on the surface to be covered. An increase in the complexity of laying the blocks thus results in increase in the cost of installation and thus economically detracts from the attractiveness of the paving blocks even though the blocks may be mechanically efficient to resist displacement forces and to also provide an aesthetic appearance.

SUMMARY OF THE INVENTION

In accordance with this invention, an improved paving block is provided having a peripheral configuration of unique and advantageous design that enhances mechanical interlocking of one paving block with respect to a plurality of adjacent similarly configured paving blocks. Paving blocks embodying one design configuration of this invention are formed with interlocking tongue elements that project laterally from the peripheral sidewall of the block and into contacting engagement with a wall surface defined as an abutment surface of the block placed adjacent to each such tongue as well as to a surface of a tongue element of yet another adjacently disposed block. This configuration results in forming of a mechanical interlock between three adjacently disposed block, thereby enhancing the ability of this uniquely configured block to resist forces that would otherwise tend to laterally displace the blocks and disrupt a paved surface that is formed with these paving blocks.

Paving blocks of modified configurations embodying the invention are provided and which also are of an advantageous design that enhances the mechanical interlocking of a plurality of the blocks laid in adjacent relationship to form a paved surface. One form of modified configuration paving blocks includes a single tongue element projecting laterally from the peripheral side wall of the block and two abutment wall surfaces which are each configured to mechanically interengage with a respective tongue element of each of two adjacently disposed paving blocks. This configuration also results in forming of a mechanical interlock between three adjacently disposed blocks to obtain the enhanced stability through greater resistance to laterally displacing forces.

Another configuration modification of a paving block embodying this invention has one tongue element projecting laterally from a peripheral side wall of the block and a single abutment wall surface. The single tongue and abutment surface mechanically interengages and interlocks with respective tongue and abutment surface of adjacently disposed paving blocks.

The paving blocks provided by this invention are of a configuration such that they can only be laid or positioned in one orientation or arrangement with respect to adjacent paving blocks. This aspect results in substantial facilitation of laying of the blocks and does substantially reduce the time required to form a paved surface of such blocks. In addition to time saving as a consequence of manual placement of the blocks, these blocks are also uniquely adapted to be laid by machines. The geometrical configuration and characteristics are such that a machine may readily position the blocks in an appropriate orientation and to place such blocks in adjacent relationship to other blocks in the forming of a paved surface.

The paving blocks as configured in accordance with this invention may also be formed with a unique surface configuration to enhance the ornamentality or aesthetic appearance of the completed paved surface comprising a plurality of the blocks. This surface configuration includes grooves formed in a particular pattern on the surface and extending across that surface which, in cooperation with chamfered edges, results in a visually appealing appearance of the completed paved surface.

These and other objects and advantages of the paving blocks of this invention will be readily apparent from the following detailed description of an illustrative embodiment thereof having an advantageous configuration and the accompanying drawings showing that embodiment.

DESCRIPTION OF THE DRAWING FIGURES

DETAILED DESCRIPTION OF AN ILLUSTRATIVE EMBODIMENT OF THE INVENTION

Having reference to FIGS. 1–4 of the drawings, a paving block 10 embodying the unique and advantageous configuration of this invention is shown individually and also in association with a plurality of same configured blocks to form a paved surface area. Each of said paving blocks is formed with a primary body section 11 which is of a planar configuration and of a generally rectangular shape in plan view having top and bottom surfaces 12 and 13. The top and bottom surfaces 12 and 13 are advantageously formed in coplanar relationship to each other whereby laying of blocks on the prepared surface results in a flat paved surface area. Extending between the top and bottom surfaces 12 and 13 is a peripheral side wall indicated generally at 14. Each of these paving blocks may be of a size having a general six (6) inch square shape in plan view. Thickness of the blocks may be varied in accordance with the particular intended primary utilization. For residential driveways, blocks about two and three-eighths inch in thickness provide sufficient stability, whereas blocks of greater thickness, such as up to three and three-fourths inch, may be necessary for commercial uses where heavier traffic is expected and which would apply greater compressive force.

Figure 4:
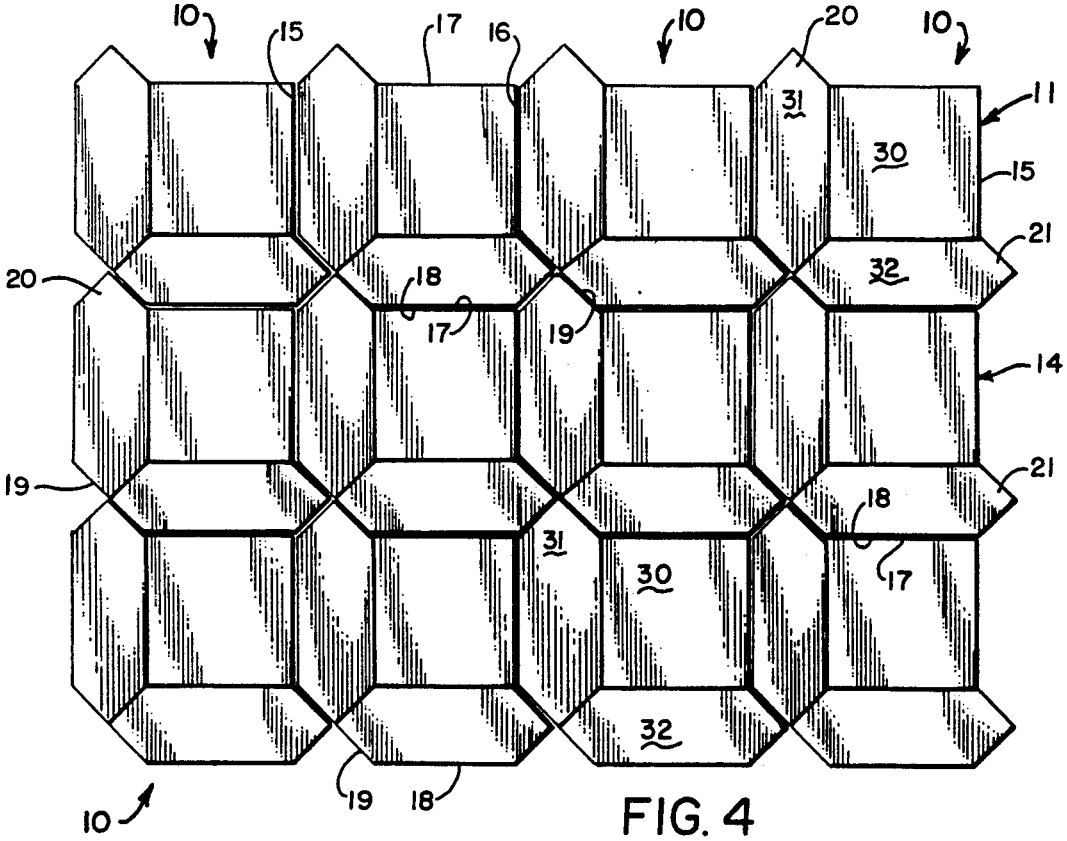
FIG. 4 is a plan view of a plurality of the FIG. 1 paving blocks formed into a paved surface area.

The side wall 14 includes four main wall elements 15, 16, 17 and 18. These main wall elements as can be best seen in FIG. 2 and also in FIG. 4 are oriented in parallel pairs and which are also arranged in orthogonal relationship. When disposed in a paved surface area such as is diagrammatically illustrated in FIG. 4, it will be seen that the wall elements 15 will abut and contactingly engage a respective wall element 16 of an adjacent block. Similarly, it will be seen that the wall elements 17 will contact and mechanically interengage with a wall element 18 of an adjacent block.

Included in the peripheral side wall 14 is a fifth wall element 19. This fifth wall element is positioned to extend angularly across the otherwise generally rectangularly shaped body section 11. In particular, it is positioned to extend between the adjacent orthogonally disposed wall elements 16 and 18 and is oriented with respect to those walls at a 45 degree angle and, as will be seen, functions as an abutment surface. As will become apparent, this fifth wall element may be broadly referred to as cooperative interlock means.

Two tongue elements 20 and 21 are provided to cooperatively interfit with the fifth wall element and respective ones of similar tongue elements formed on adjacently disposed blocks to effect mechanical interlocking of the blocks in a paved surface area and are broadly referred to as interlock means. Each tongue element 20 and 21 in this illustrative embodiment of the invention is triangularly shaped having respective vertical side walls 22, 23 and 24, 25. These tongue elements 20 and 21 are integrally molded with the primary body section 11 and are disposed at diametrically opposed corners that are each next adjacent the corner formed by the fifth wall element 19. The respective side walls 22 and 23 form continuations of the adjacent side walls 16 and 17 while the side walls 24 and 25 form continuations of the wall elements 15 and 18.

The cooperation and interrelationship of the various wall elements and side walls in forming of an interlocked paved surface area comprising a plurality of the paving blocks 10 can be best seen by reference to FIG. 4. As was previously noted, the main wall elements 15–18 each abut and contactingly engage with another one of such elements of adjacently disposed blocks to cooperate in maintaining the blocks in their desired positions. Further enhancement of the stability of the block pattern is obtained through the unique configurations of the tongue elements 20 and 21 that are broadly defined as interlock means and which cooperate with each other and with the fifth wall element 19 of adjacent blocks with the fifth wall element broadly defined as cooperative interlock means. This can be readily seen in FIG. 4 where the side walls 22 and 25 of the tongue elements 21 and 20, respectively, of two blocks contact each other and the side walls 24 and 23 contact and mechanically interengage with the fifth wall element 19. Thus, it will be readily seen that there is a three-way mechanical interlock obtained through the unique configuration of the paving block at a corner of three adjacently disposed paving blocks. This unique configuration contributes to the greater stability of the paving blocks and maintenance of the blocks in their desired position when laid in forming of a paved surface.

In accordance with this invention, the upper area or surfaces of the paving blocks are configured to provide an aesthetically pleasing visual appearance. To achieve this visual appearance, the top surface 12 is provided with a set of three grooves 26, 27 and 28 which are arranged and disposed to have two of the grooves 26 and 27 disposed in orthogonal relationship to each other. The third groove 28 is positioned to extend from the fifth wall element 19 and interconnect with the juncture of the two grooves 26 and 27. This results in forming of three distinct surface areas of specific geometric patterns. Locating the grooves 26 and 27 to extend perpendicular with respect to the respective wall elements 17 and 15 at their juncture with the respective tongue elements 20 and 21 results in formation of a square surface area and two elongated diamond shaped surface areas 31 and 32. This shape of the surface areas is obtained through selection of proportioned dimensions which, in an illustrative embodiment, may be of six inch spacing as between opposed wall elements 15 and 16 and 17 and 18 and the tongue elements 20 and 21 each having a base width of two inches. To complement the design appearance obtained through the formation of the grooves 26, 27 and 28 the entire periphery of the block at its upper corner is chamfered as at a 45 degree angle forming respective surfaces that are identified by the respective wall surface number with the subscript "a". In the embodiment having the six inch dimensional configuration, the grooves 26, 27 and 28 may advantageously have a dimension of 3/16" radius and the chamfered side walls having vertical and horizontal dimensions of 3/16". Thus, when the blocks are positioned in adjacent relationship, the chamfered surfaces of the side walls will combine to form a V-shaped groove having the same dimensional size as those of the rounded grooves 26, 27 and 28. This results in a unique and pleasing visual appearance of the surface patterns.

It will be readily apparent from the particular configuration of the paving block as to its peripheral side wall that each block may be oriented in only one relationship to any adjacent block to form a paved surface. This configuration results in convenience when either manually laying the blocks or more advantageously permits utilization of block laying machines that have been developed for this purpose. A single orientation block with the groove and chamfered upper surface areas results in a visually pleasing appearance of the finished paved surface area formed from such blocks. It is also readily seen that a unique configuration of the tongue elements and fifth wall element results in a secure mechanical interlocking of the adjacently disposed blocks, thereby further enhancing the stability of the paved surface area.

While the paving block shown in FIGS. 1–4 has a particular configuration uniquely enabling it to perform the advantageous mechanical interlocking function, as well as forming a paved surface having an aesthetically pleasing appearance, this specific configuration can be modified to generate paving blocks of different configuration, but which still embody this invention. The configuration of the tongue elements can be modified along with that of the peripheral wall elements which cooperate with those tongue elements to provide a paving block that is not only aesthetically pleasing, but which is capable of performing the mechanical interlocking function. FIGS. 5–12 of the drawings illustrate four modified paving blocks that are of different configurations, but which embody the utilitarian aspects of this invention. These modified paving blocks include tongue elements and peripheral wall elements that perform the mechanical interlocking function and are of a configuration that each can be oriented in, but one way with respect to other paving blocks to form a paved surface of aesthetically pleasing appearance.

Each of the four paving blocks of modified configuration is shown in top plan view only as the complete configuration is readily understood in view of the detailed illustration of the paving block shown in FIGS. 1–4. These modified blocks are each of generally rectangular or square configuration in plan view with top and bottom surfaces that are coplanar and a peripheral wall extending perpendicularly between those surfaces. The modified paving blocks shown in FIGS. 5–12 have a top surface formed with ornamentive features similar in nature to that of the FIG. 1 block to provide a particular aesthetic appearance to a paved surface formed with a number of the same configured blocks. Particulars of mechanical and aesthetic features of these four specific variations are specifically described in following paragraphs.

Figure 5:
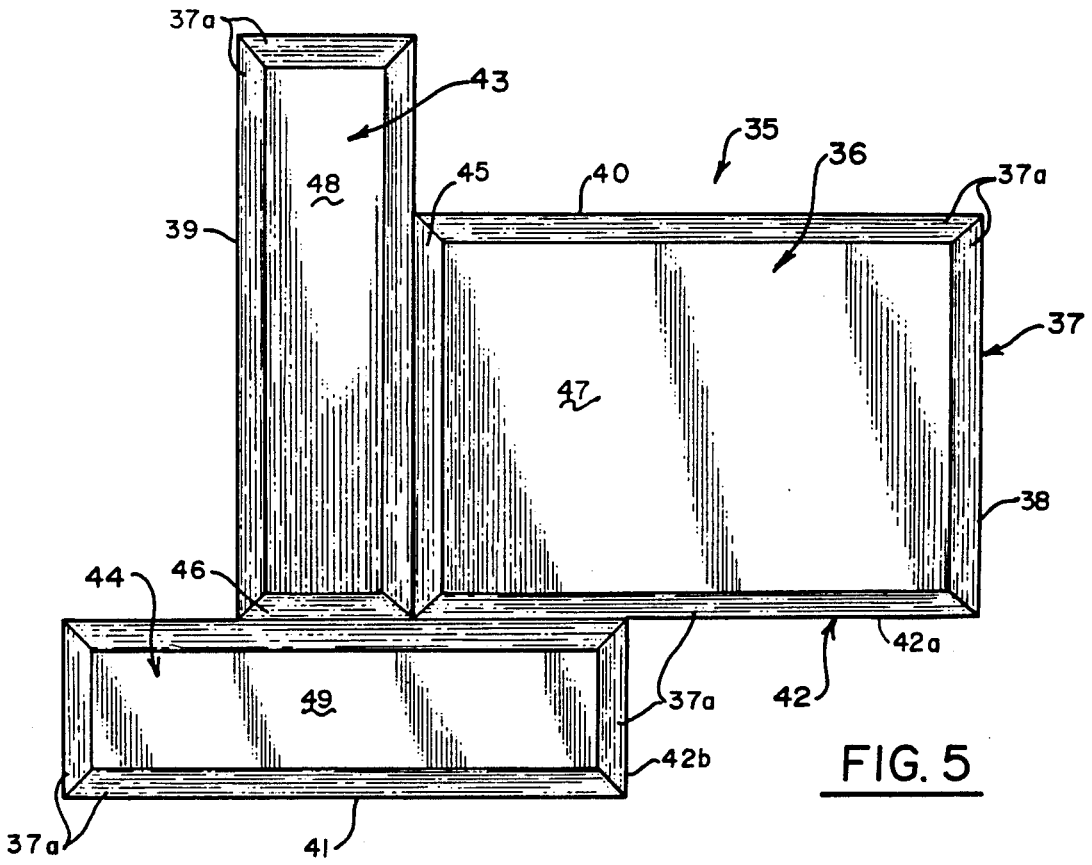
FIG. 5 is a top plan view of a paving block of modified configuration embodying this invention.
Figure 6:
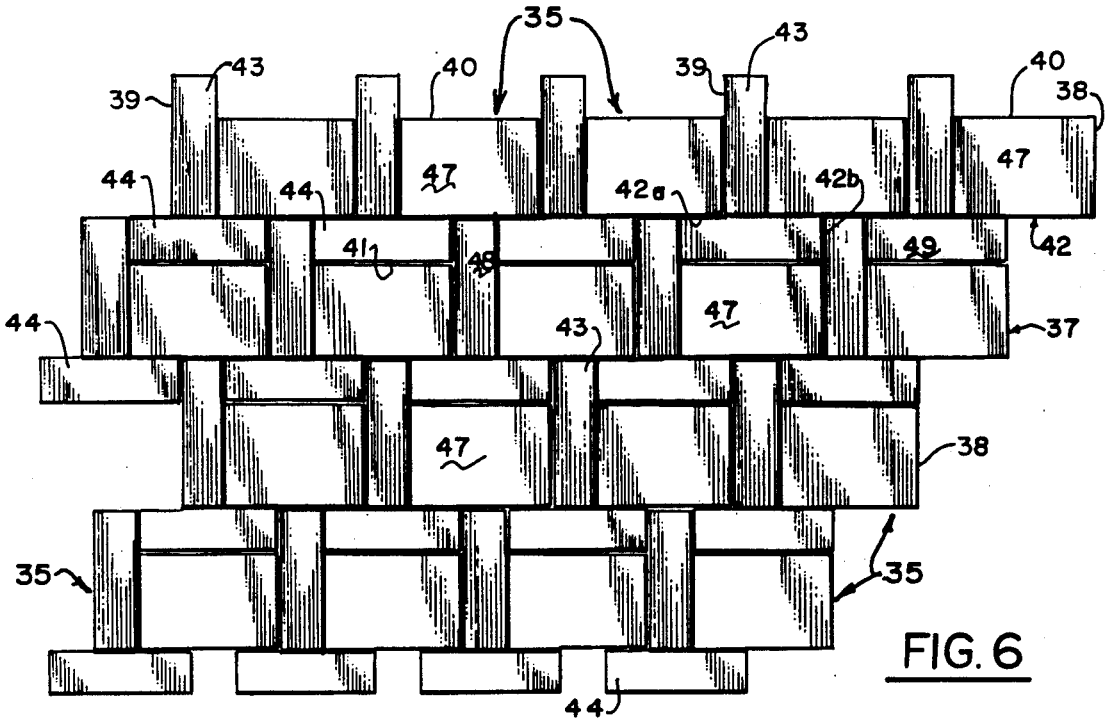
FIG. 6 is a plan view of a plurality of the FIG. 5 paving blocks formed into a paved surface area.

Referring to FIGS. 5 and 6, this modified paving block is characterized as of "rectangular" shape in plan view and is generally designated by the numeral 35. It has a top surface 36 and vertical side wall 37 extending around its entire periphery. Pairs of main wall elements 38, 39 and 40, 41 are disposed in parallel relationship and are each adapted to contact in abuting relationship to the main wall elements of adjacently disposed paving blocks as can be seen in FIG. 6. A fifth wall element 42 which is of L-shaped configuration having orthogonally disposed components **42*a* and 42*b* forms an abutment surface for mechanical interlocking with each of two tongue elements 43 and 44 of each of two adjacently disposed blocks. These tongue elements 43 and 44 which extend in orthogonal relationship to each other are of equally dimensioned square shape with the fifth wall element 42 similarly dimensioned to receive two tongue elements as can be seen in FIG. 6. Positioning of paving blocks 35** of this configuration on a surface results in mechanical interlocking of three adjacently disposed blocks to better resist relative lateral displacement and result in enhanced stability of a paved surface formed with a number of these blocks.

Figure 1:
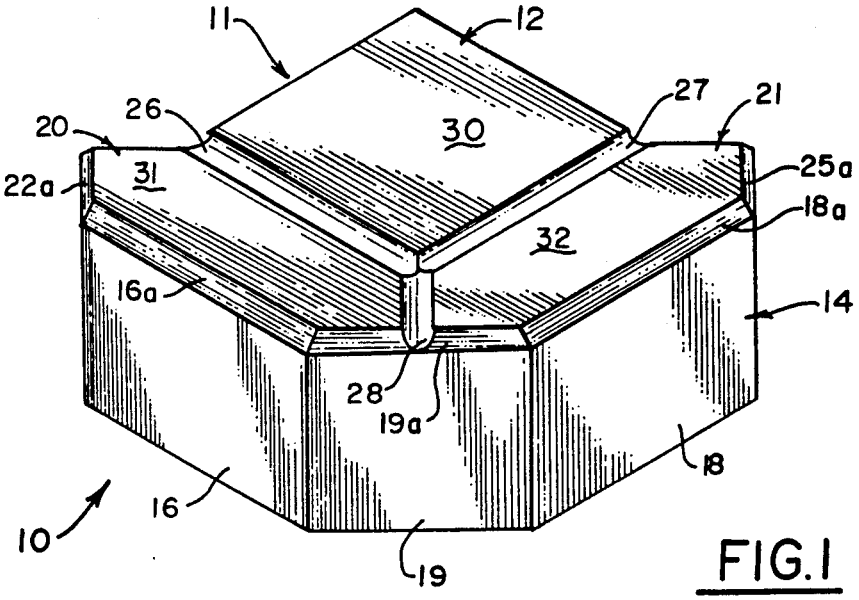
FIG. 1 is a perspective view of a paving block embodying this invention.
Figure 2:
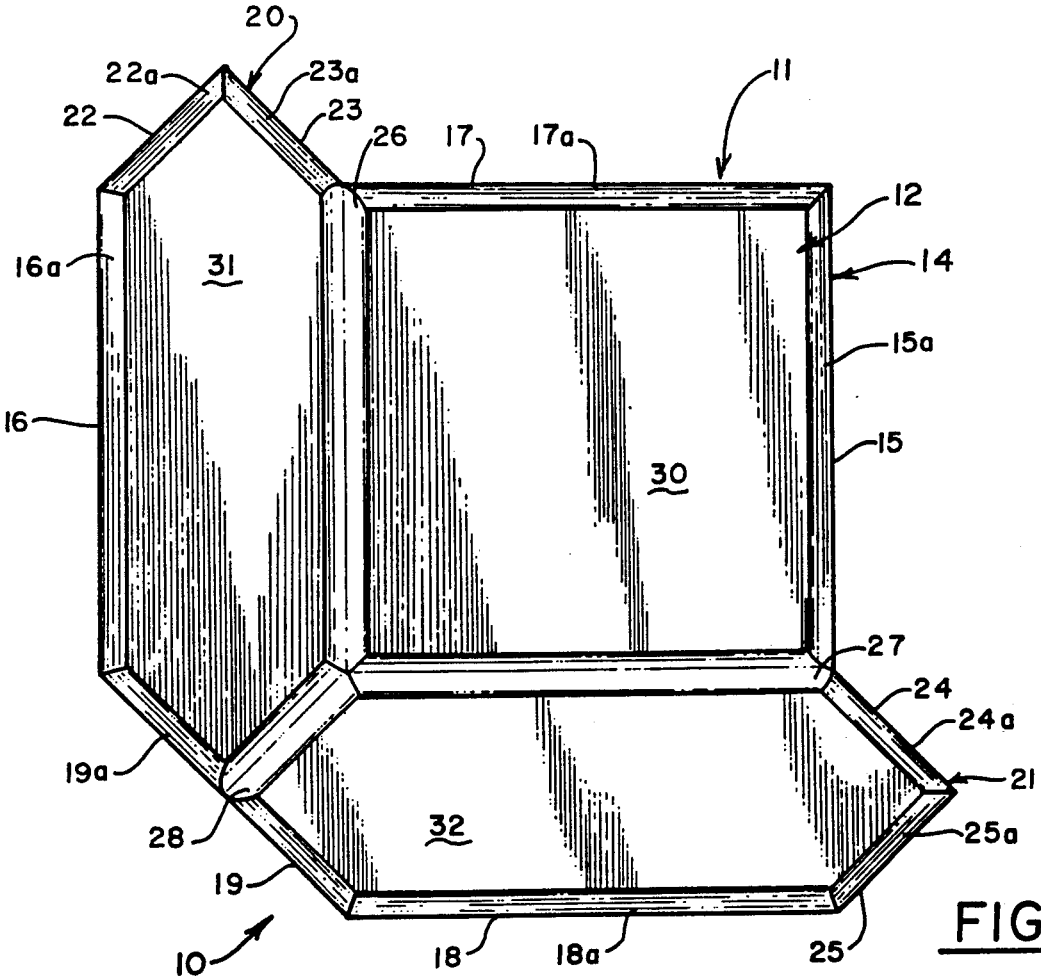
FIG. 2 is a top plan view on an enlarged scale of the paving block.
Figure 3:
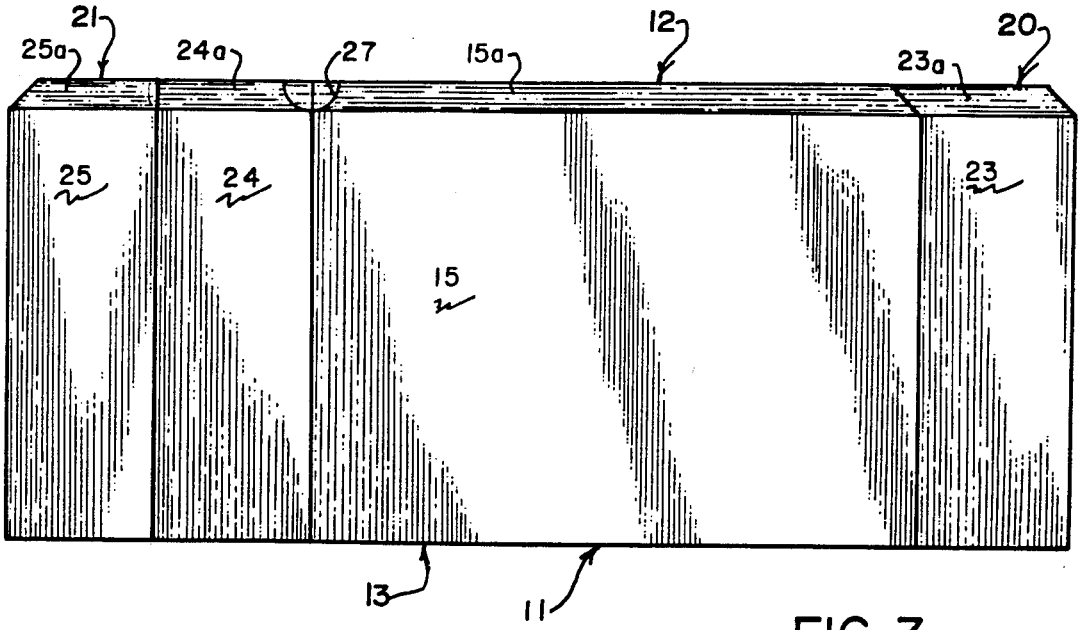
FIG. 3 is an elevational view on a further enlarged scale as seen from the right side of FIG. 2 with an elevational view as seen from the top of FIG. 2 being a mirror image.

While the paving block 35 of FIG. 5 has an aesthetically pleasing appearance in its basic block configuration having the two tongue elements 43 and 44 and L-shaped fifth wall element 42, its visual appearance is further enhanced by providing a beveled edge **37*a* extending around the entire periphery of the block in the same manner as with the block of FIG. 1. This beveled edge 37*a* is complemented by two V-shaped grooves 45 and 46 formed in the top of the block in orthogonal relationship to each other. These grooves 45 and 46 each have sides that are complementary to the beveled edge 37*a* resulting in continuations of V-shaped grooves formed by the cooperative beveled edge portions of adjacently disposed blocks. The beveled edge 37*a* and the two grooves 45 and 46 divide the top surface of the block into three distinctive rectangular surface areas 47, 48 and 49**.

Figure 7:
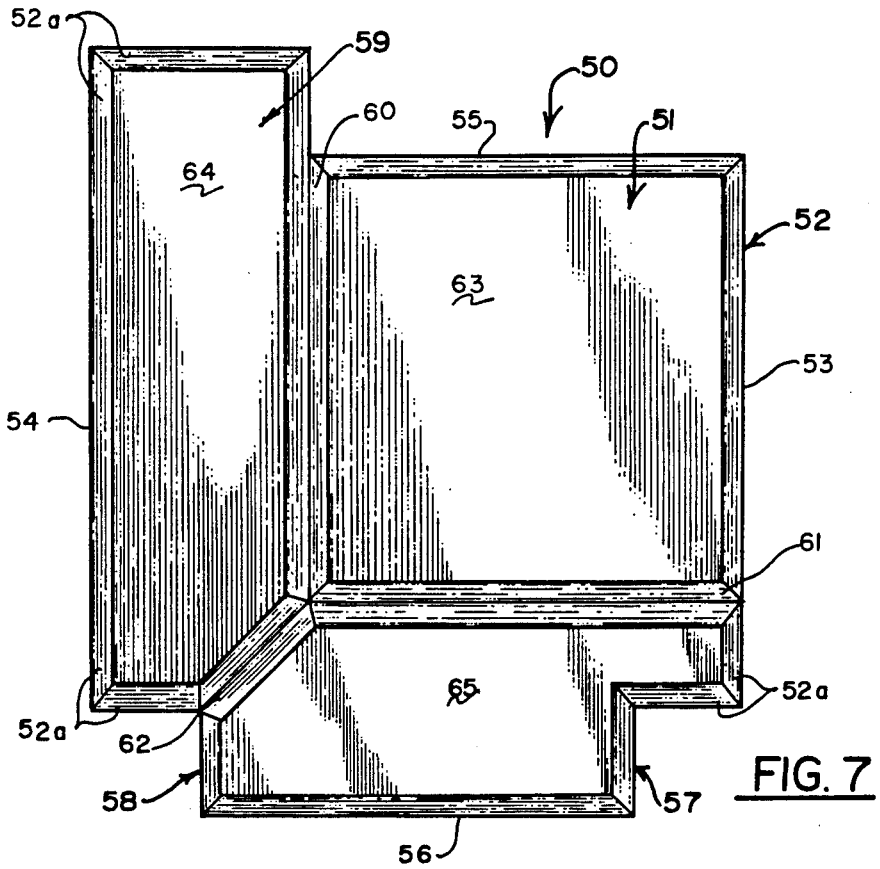
FIG. 7 is a top plan view of a paving block of another modified configuration embodying this invention.
Figure 8:
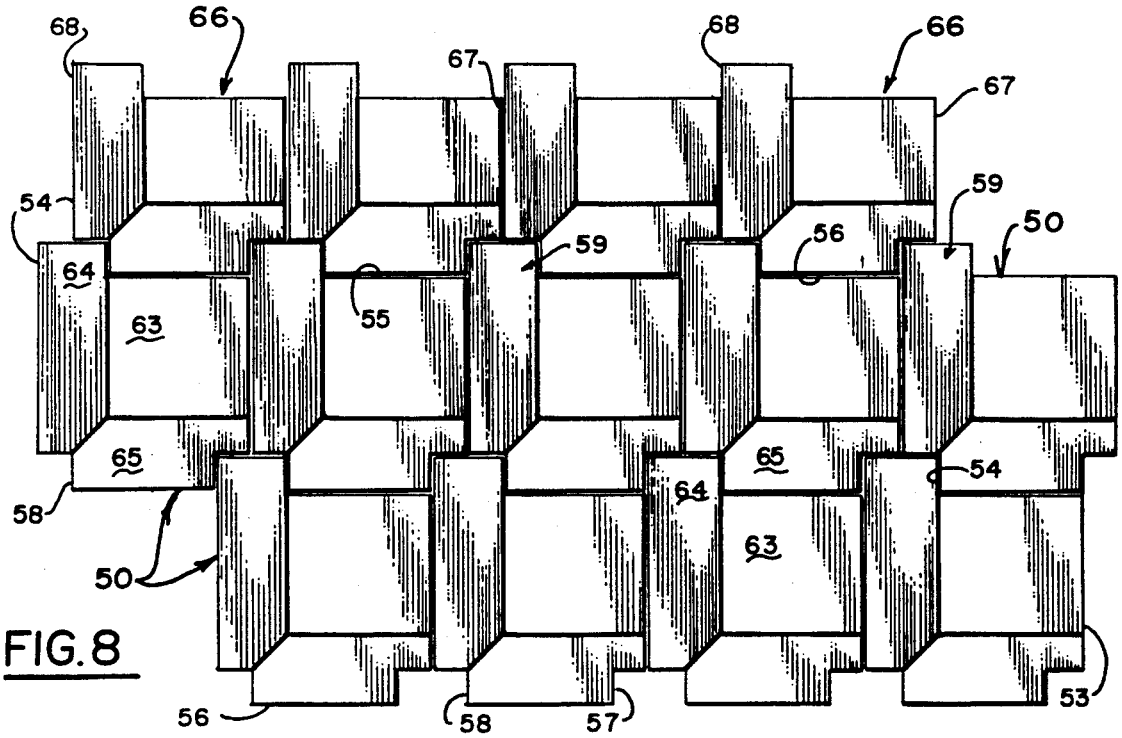
FIG. 8 is a plan view of a plurality of the FIG. 7 paving blocks formed into a paved surface area.

FIGS. 7 and 8 illustrate a modified paving block generally designated by the numeral 50 having a configuration characterized in plan view as "square". It also has a top surface 51 and a vertical side wall 52 extending around its entire periphery. The peripheral side wall 52 has pairs of main wall elements 53, 54 and 55, 56 disposed in parallel relationship and which are each adapted to contact in abuting relationship to the respective main wall elements of adjacently disposed paving blocks as can be seen in FIG. 8. This block also includes a fifth wall element, but this fifth wall element is formed in two sections 57 and 58 that are of L-shape with equal length sides and are disposed at each of two adjacent corners. A single tongue element 59 is provided and projects laterally from the block at a side opposite from the fifth wall elements. The tongue element 59 has a length equal to the depth of the fifth wall elements 57 and 58 and a width that is twice the length of the sides of the fifth wall elements. As can be seen in FIG. 8, the tongue element 59 of one block 50 will interfit with one of the fifth wall element sections 57 and 59 of each two other adjacently disposed blocks resulting in the advantageous mechanical interlocking for enhanced stability of the paved surface formed by these blocks.

Again, for enhancement of visual apparance of the blocks 50 shown in FIG. 7 and the resultant paved surface formed by a plurality of these blocks, the block is formed with a beveled edge 52*a* which extends around the entire periphery of the block. Additionally, three grooves 60, 61 and 62 are formed in the top of the block and result in formation of three distinctive top surface areas 63, 64 and 65. These grooves are shown as being of V-shape, but they could be of circular shape as are the grooves in the FIG. 1 block.

A further variation technique that can be utilized to obtain different visual appearances is shown in FIG. 8, although it will be understood that this technique is not limited to this FIG. 7 type of block. This technique consists of modifying the dimensions of the block in one direction. The bottom two rows of the representative surface area are formed with blocks 50 that are proportionally dimensioned as the block is shown in FIG. 7. The top row is formed with blocks 66 that are comparatively dimensionally modified by a reduction in overall vertical dimension as referenced to FIG. 8. Specifically, the main wall elements 67 and 68 are reduced by a predetermined extent which is of the order of one-sixth in this example. In a similar manner, the blocks could be reduced in horizontal dimension to achieve yet another visual appearance.

Figure 9:
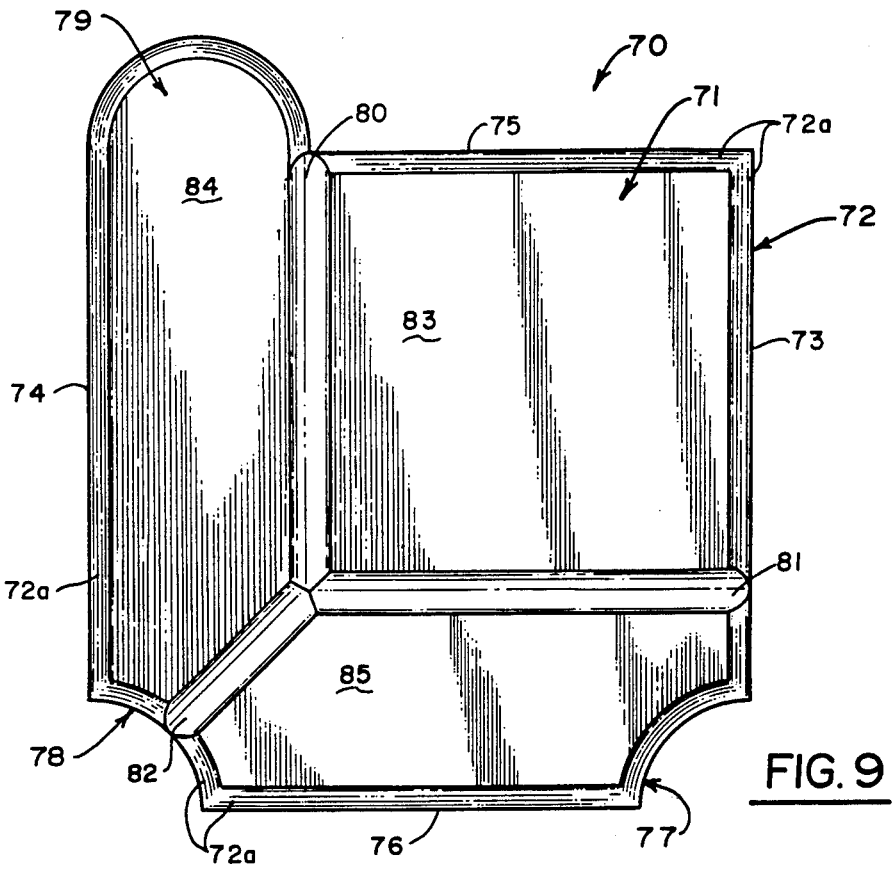
FIG. 9 is a top plan view of a paving block of another modified configuration embodying this invention.
Figure 10:
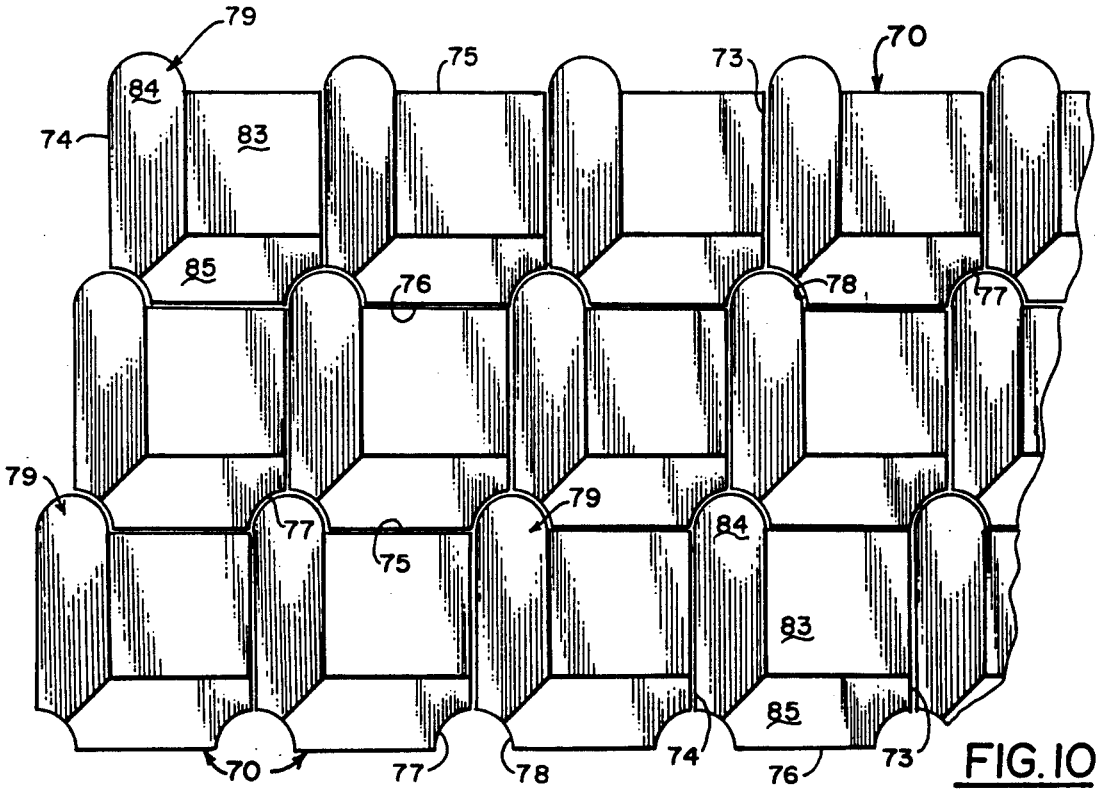
FIG. 10 is a plan view of a paved surface area formed with a plurality of the FIG. 9 paving blocks.

A third variation of the paving block as shown in FIGS. 9 and 10 and designated generally by the numeral 70 is a minor variation of the configuration of the block 50 of FIG. 7. This block 70 has a top surface 71 and vertical side wall 72 extending around the periphery with the side wall having four main wall elements 73, 74, 75 and 76 disposed in parallel pairs. It has a fifth wall element formed in two sections 77 and 78 at adjacent corners and has a single tongue element 79. The difference with respect to block 50 of FIG. 7 is that the edge portions defining the fifth wall elements and tongue elements are arcuately shaped, but they interfit in the relationship to provide the mechanical interlock as between three adjacently disposed blocks. This modified block also has a beveled peripheral edge 72*a* extending around the entire periphery and has three grooves 80, 81 and 82 formed in the top resulting in defining of three distinctively shaped top surfaces 83, 83 and 85. The grooves 80, 81 and 82 are shown as being of arcuately curved shape.

Figure 11:
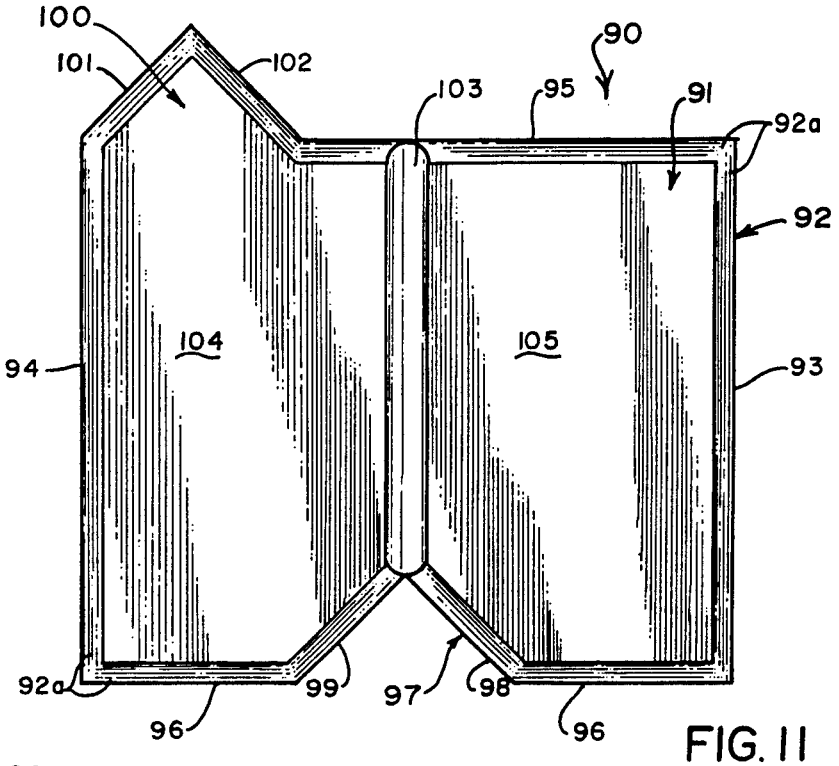
FIG. 11 is a top plan view of a paving block of another modified configuration embodying this invention.
Figure 12:
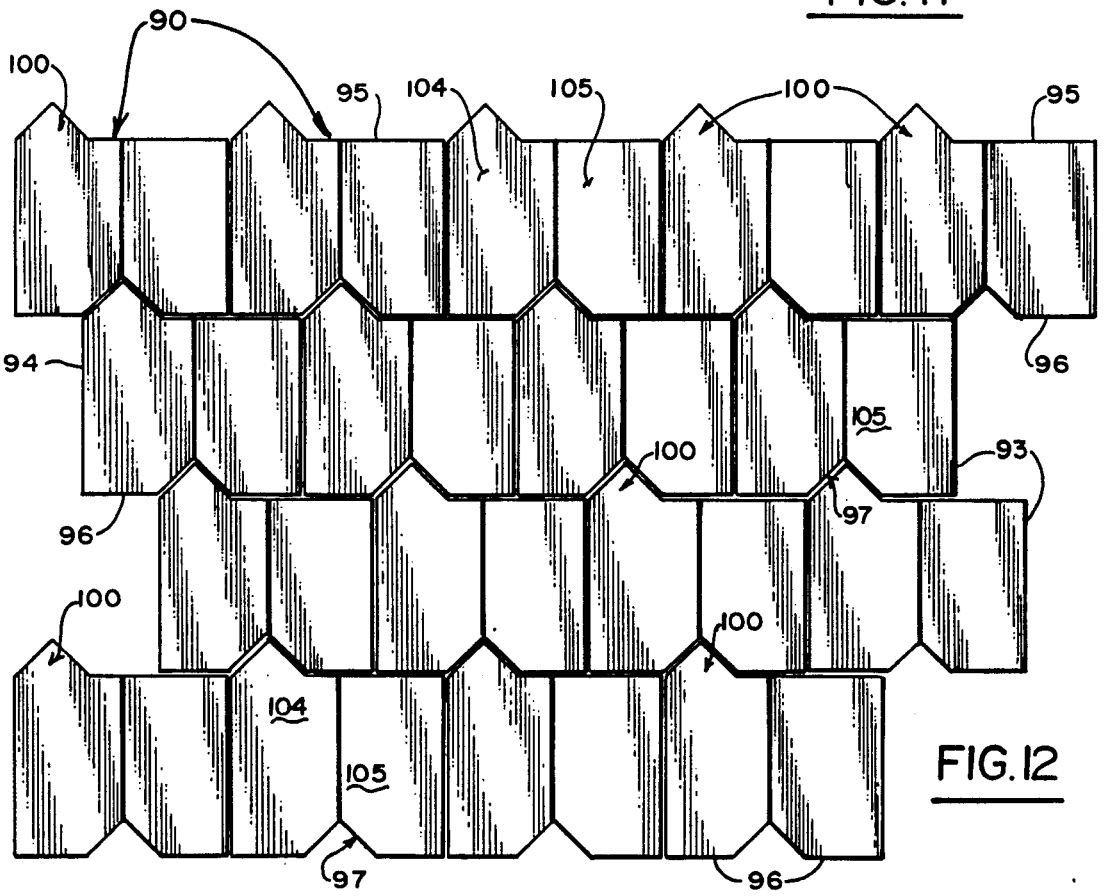
FIG. 12 is a plan view of a paved surface area formed with a plurality of the FIG. 11 paving blocks.

The fourth modification of a paving block embodying this invention is shown in FIGS. 11 and 12 and is generally designated by the numeral 90. This block is of generally square shape having a top surface 91 and a vertically oriented peripheral side wall 92. The side wall includes four main wall elements 93, 94, 95 and 96 that are disposed in parallel pairs adapted to contact respective main wall elements of adjacently disposed blocks of similar configuration when laid to form a paved surface area as can be seen in FIG. 12. This paving block 90 also has a fifth wall element 97 formed at substantially the midpoint of the main wall element 96 and which is of V-shape having two side elements 98 and 99 converging in an inward direction with respect to the wall 96. A single tongue element 100 is formed to project laterally outward from the block at the side opposite to that in which the fifth wall element is formed. The tongue element is also V-shaped with two side elements 101 and 102 and is complementally dimensioned to mechanically interfit with a fifth wall element 97 of an adjacently disposed block as can be seen in FIG. 12. It will be noted that with the tongue element 100 formed adjacent the side of the block defined by the main wall element 94 and thus in laterally offset relationship to the fifth wall element 97, the blocks in adjacent rows will not only mechanically interlock as between the tongue and fifth wall elements of two, but will also provide further mechanical interlock of the block with the tongue element with a third block, thereby resulting in enhanced stability of a paved surface formed from the paving block 90 of this modified configuration.

For purposes of visual appearance, the illustrated block 90 has a beveled edge 92*a* formed around its periphery in the same manner as in the case of the block 10 of FIG. 1. Additionally, the block 90 has a single arcuately curved groove 103 extending between the wall elements 95 and 96 resulting in dividing of the top surface 91 into two distinctive surface areas 104 and 105.

Each of the paving blocks of modified configuration will also be readily understood to provide the desired and advantageous mechanical interlock for achieving enhanced stability of a surface formed from paving blocks embodying this invention. Their configuration also enables utilization of machines to lay these blocks which are placed in a single orientation. While specific configurations are shown, it will be readily apparent that further modification may be devised to create blocks that may have different visual appearance for aesthetic purposes, but which will embody the advantageous mechanical interlocking features of this invention.

Having thus described the invention, what is claimed is:

1. A paving block adapted for disposition in adjacent relationship to a plurality of the same blocks to form a paved surface overlying a supporting surface, said paving block comprising a body section of planar configuration formed with top and bottom surfaces and a peripheral side wall extending between said top and bottom surfaces, said peripheral side wall being formed with interlock means and cooperative interlock means that are each adapted to mechanically interengage with respective opposite ones of said interlock and cooperative interlock means of adjacently disposed paving blocks to resist displacing forces directed laterally with respect to said peripheral side wall, said interlock means including at least one tongue element projecting a distance laterally outward in the plane of the paving block with respect to said peripheral side wall and said cooperative interlock means including an abutment surface relatively positioned with respect to said tongue element to interfit and mechanically interengage with a tongue element of at least one adjacently disposed paving block, said interlock means and said cooperative interlock means being of a predetermined configuration and relatively disposed to each other whereby the paving block can be oriented in only one position to interfit with other same paving blocks disposed in adjacent, mechanically interengaging relationship thereto and to form only a single surface pattern from a plurality of the same paving blocks.

2. A paving block according to claim 1 wherein said top and bottom surfaces are coplanar to cooperatively form a contiguous surface with the respective top and bottom surfaces of adjacently disposed paving blocks.

3. A paving block according to claim 1 wherein said top surface is planar to cooperatively form a contiguous surface with the top surfaces of adjacently disposed paving blocks.

4. A paving block according to claim 1 wherein said interlock means includes a second tongue element which projects a distance laterally outward in the plane of the paving block with respect to said peripheral side wall, said two tongue elements being disposed in spaced, predetermined relationship with respect to each other around the periphery of the paving block whereby each tongue element will mechanically interengage with the abutment surface of said cooperative interlock means of an adjacently disposed paving block and a tongue element of a second adjacently disposed paving block.

5. A paving block according to claim 1 wherein said interlock means includes a second tongue element which projects a distance laterally outward in the plane of the paving block with respect to said peripheral side wall, said two tongue elements being disposed in spaced, predetermined relationship with respect to each other around the periphery of the paving block whereby each tongue element will mechanically interengage with the abutment surface of said cooperative interlock means of one adjacently disposed paving block and mechanically interengage with a tongue element of a second adjacently disposed paving block and with the abutment surface of the cooperative interlock means mechanically interengaged with a tongue element of each of two adjacently disposed paving blocks.

6. A paving block according to claim 5 wherein each of said tongue elements is of triangular shape in plan view having first and second side wall surfaces disposed in angular relationship to each other and extending in converging relationship in a direction outwardly with respect to the block, said two tongue elements disposed in orthogonal relationship to each other.

7. A paving block according to claim 5 wherein said tongue elements are of rectangular shape in plan view and are disposed in orthogonal relationship to each other, said fifth wall element being of an L-shape in plan view and dimensional configuration to receive one tongue element of each of two adjacently disposed blocks.

8. A paving block according to claim 1 wherein said interlock means includes one tongue element of predetermined configuration and the abutment surface of said cooperative interlock means is formed in two sections, said two sections disposed in relatively spaced relationship to each other along said peripheral side wall with each section being of a configuration and oriented with respect to the paving block to complement an abutment surface section of an adjacently disposed block for cooperatively forming a recess dimensionally configured to receive a tongue element of another adjacently disposed block in mechanical interengagement therewith.

9. A paving block according to claim 8 wherein said tongue element projects laterally outward with respect to said peripheral wall along an axis oriented in predetermined relationship to the block, each section of said abutment surface disposed in laterally offset relationship to the axis along which said tongue element is oriented and defining a cavity forming a portion of said recess, each section opening in a direction both laterally and parallel to the tongue element axis.

10. A paving block according to claim 9 wherein said tongue element is of rectangular shape in plan view and said abutment surface sections are of a configuration to cooperatively define a recess of rectangular shape in plan view.

11. A paving block according to claim 9 wherein said tongue element is of arcuate shape in plan view and said abutment surface sections are arcuately shaped in plan view to be complemental to a portion of said tongue element.

12. A paving block adapted for disposition in adjacent relatioship to a plurality of the same blocks to form a paved surface overlying a supporting surface, said paving block comprising a body section of planar configuration formed with top and bottom surfaces and a peripheral side wall extending between said top and bottom surfaces, said peripheral side wall including four main wall elements disposed in orthogonally oriented pairs, each of said wall elements adapted to interfit with a respective one of a wall element of an adjacently disposed block in mechanical interengagement therewith, and a fifth wall element extending between two adjacent ones of said main wall elements in equiangular relationship to each of said two main wall elements, and first and second interlocking tongue elements each projecting laterally outward in the plane of the block from a respective one of each of the other of said main wall elements, each of said tongue elements being of triangular shape in plan view having first and second surfaces disposed in orthogonal relationship to each other and extending in converging relationship from the respective main wall element, one of said first and second surfaces of each of said tongue elements adapted to be disposed in mechanical interengagement with a portion of the fifth wall element of a first adjacently disposed block in cooperation with a first or a second surface of one of the interlocking tongue elements of a second adjacently disposed block with the other of said first and second surfaces adapted to be disposed in mechanical interengagement with the other of the first or second surfaces of the tongue element of the second adjacently disposed block, said first and second interlocking tongue elements being of a predetermined configuration and relatively disposed to each other whereby the paving block can be oriented in only one position to interfit with other same paving blocks disposed in adjacent, mechanically interengaging relationship thereto and to form only a single surface pattern from a plurality of the same paving blocks.

* * * * *